United States Patent [19]

Derby

[11] Patent Number: 4,811,419

[45] Date of Patent: Mar. 7, 1989

[54] RECEPTACLE HAVING IMPROVED HOPPER

[75] Inventor: Norwin C. Derby, Sherman, Tex.

[73] Assignee: Better Agricultural Goals, Inc., Dallas, Tex.

[21] Appl. No.: 185,981

[22] Filed: Apr. 25, 1988

[51] Int. Cl.[4] ..... B65D 33/16

[52] U.S. Cl. ..... 383/67; 383/904; 383/906; 383/121; 222/530

[58] Field of Search ..... 383/67, 42, 16, 21, 383/36, 906, 904, 121, 125, 103; 222/530

[56] References Cited

U.S. PATENT DOCUMENTS

| | | | |
|---|---|---|---|
| 2,421,962 | 6/1947 | Pearl | 383/67 |
| 2,672,213 | 3/1954 | Cropley | 383/904 |
| 2,995,205 | 8/1961 | Cordell | 383/904 |
| 4,143,796 | 3/1979 | Williamson et al. | 222/185 |
| 4,299,605 | 11/1981 | Aiyama et al. | 383/67 |
| 4,457,456 | 7/1984 | Derby et al. | 222/105 |
| 4,691,371 | 9/1987 | Derby | 383/67 |
| 4,759,473 | 7/1988 | Derby et al. | 383/67 |

*Primary Examiner*—Willis Little

*Attorney, Agent, or Firm*—Michael A. O'Neil

[57] ABSTRACT

A material holding receptacle constructed of pliable material and having a main enclosure and a hopper below the enclosure. The hopper consists of a trapezoidal bottom piece and three triangular bottom pieces. The bottom pieces can be folded upward to form a substantially flat bottom to the receptacle. A cover piece is attached to the trapezoidal bottom piece to form a receptacle access tube over an opening in the trapezoidal bottom piece. A loop is attached to the bottom corner of one of the bottom pieces to secure the bottom pieces.

11 Claims, 2 Drawing Sheets

FIG. 1
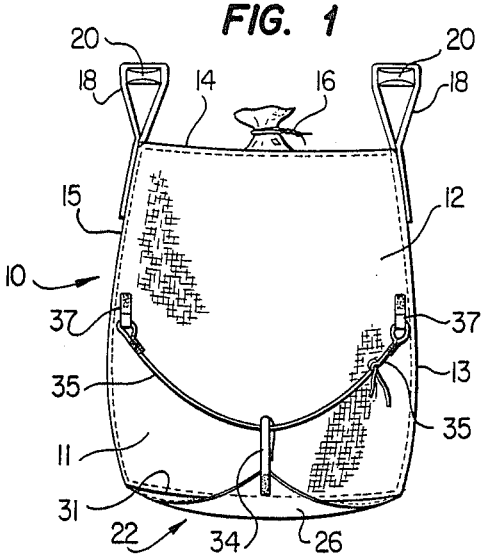
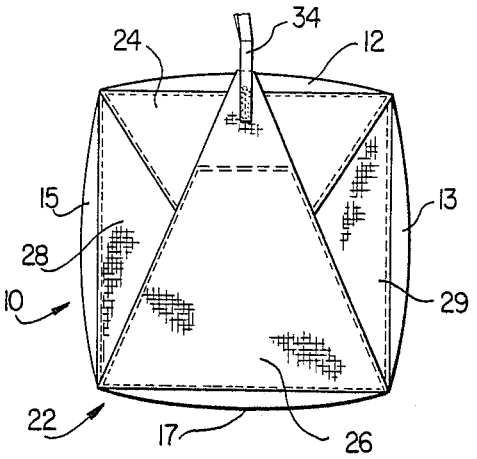
FIG. 2
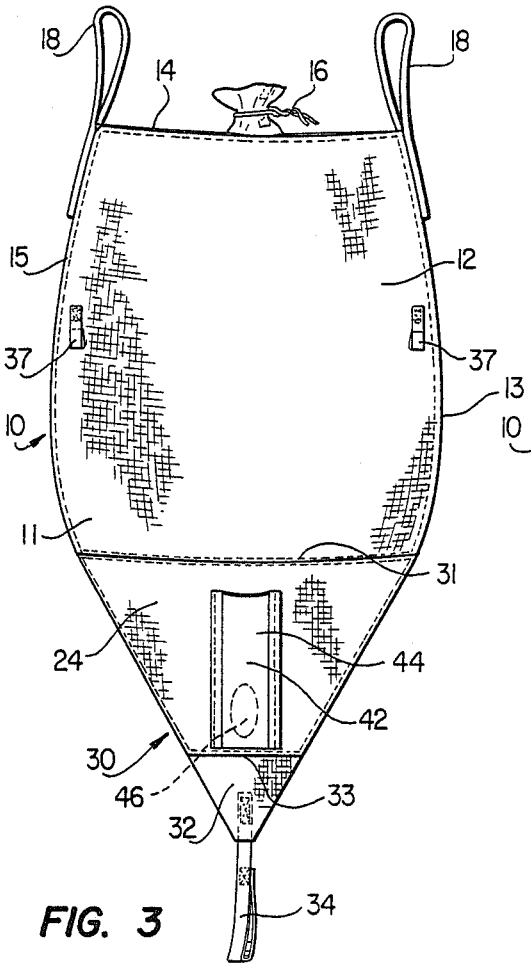
FIG. 3
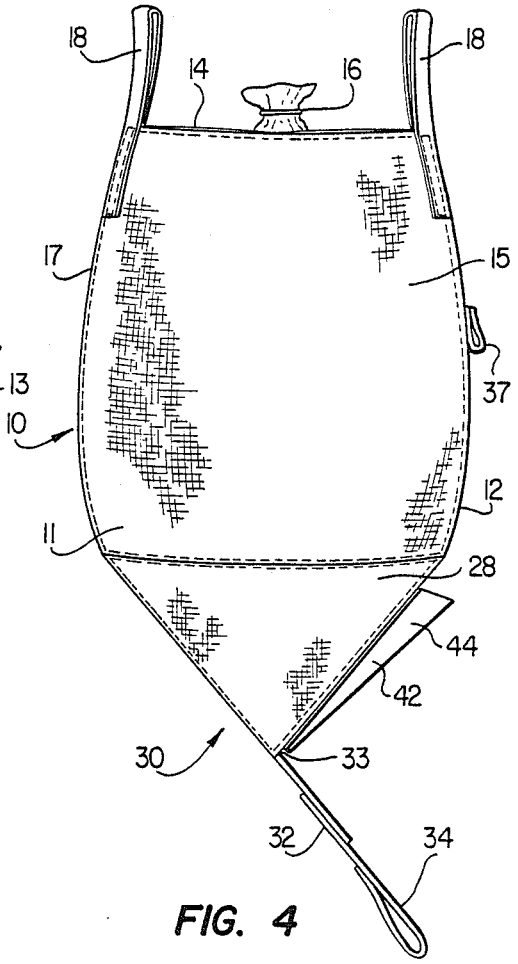
FIG. 4

RECEPTACLE HAVING IMPROVED HOPPER

TECHNICAL FIELD

This invention relates in general to receptacles for handling granular materials. In particular, the invention relates to receptacles constructed of pliable material and having hoppers for discharging granular material from the receptacles.

BACKGROUND AND SUMMARY OF THE INVENTION

Various types of receptacles have been developed for handling granular material, such as chemicals, minerals, fertilizers, food stuffs, grains, or agricultural products. Receptacles manufactured from pliable material have come into wide use due to their relatively light weight, reduced manufacturing cost, and improved versatility. A number of pliable receptacles used in the handling of granular materials are disclosed in U.S. Pat. Nos. 4,143,796; 4,194,652; 4,457,456; and 4,691,371.

Receptacles used for handling granular material usually have an opening in the bottom of the enclosure through which the material can be conveniently discharged. In most cases, a flexible tubular discharge spout extends downward from the opening to confine and direct the material flowing from the receptacle. The opening can be closed and secured by tying a wire or a strap about the discharge spout, so the receptacle can be filled and transported.

Some prior art discharge spouts have proven to be unsatisfactory for a number of reasons. For example, in order to untie some discharge spouts, an individual must stand directly below the receptacle, exposing himself to injury if the receptacle, which may weigh as much 3,000 pounds when full, is accidentally dropped. In some situations, individuals risk contacting toxic or caustic material as the material flows from the receptacle.

U.S. Pat. No. 4,691,371 shows a receptacle that has a flexible discharge spout extending from an opening in the bottom of the receptacle. A pocket on the bottom of the receptacle secures the discharge spout across the opening, preventing discharge of material. The discharge spout can be safely pulled from the pocket by an individual standing to the side of the receptacle with a hook, thereby allowing material to discharge from the receptacle.

When handling some materials, it is desirable to have a conical hopper on the bottom of the receptacle. However, a receptacle having a conical hopper cannot be set down on a flat surface. Therefore, it is difficult to carry such receptacles on pallets.

The present invention is a receptacle constructed of a strong, pliable material and having a main enclosure and four bottom pieces. The four bottom pieces are generally triangular and extend downward from the sides to form a generally conical hopper. One of the bottom pieces has an opening therein, that is closed by a cover piece. The bottom and sides of the cover piece are attached to the one bottom piece over the opening to form a tube, open at the top and closed at the bottom. The hose of a pneumatic transfer system can be inserted into the tube to draw material from the receptacle through the opening.

During transport of the receptacle, the four bottom pieces are folded up to form a flat bottom. The flat bottom allows the receptacle to be carried on a pallet or set down on a flat surface.

BRIEF DESCRIPTION OF THE DRAWINGS

A more complete understanding of the invention can be had by reference to the following detailed description when taken in conjunction with the accompanying drawings, wherein:

FIG. 1 is a side view of a receptacle incorporating the invention shown in its folded position;

FIG. 2 is a bottom view of the receptacle shown in FIG. 1;

FIG. 3 is a front view of the receptacle of the invention, shown in its open position;

FIG. 4 is a side view of the receptacle of the invention, shown in its open position;

DETAILED DESCRIPTION OF THE DRAWINGS

Figure 5:
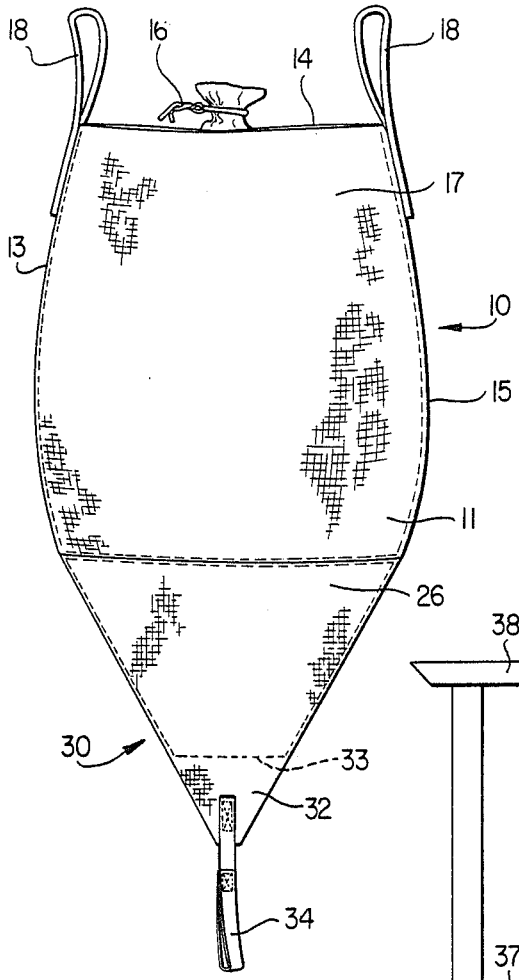
FIG. 5 is a rear view of the receptacle of the invention, shown in its open position.

FIGS. 1 and 2 show a receptacle 10 containing a quantity of granular material. The material may be for example, minerals, chemicals, fertilizers, food stuffs, or agricultural products. The receptacle 10 is constructed of a strong, pliable material, such as woven polypropylene. The receptacle may have an extrusion lining for air tightness or for moisture sensitive materials.

The main enclosure 11 of the receptacle 10 has four rectangular sides 12, 13, 15, and 17 and a top 14. After the receptacle 10 is filled with material, the top 14 can be closed and secured with a tie 16 of any known type, such as a wire.

Four support loops 18 are attached to the upper corners of the receptacle 10. These support loops 18 provide a means for holding or lifting the receptacle 10 in any desired manner. In FIG. 1, for example, the receptacle 10 is shown suspended from a pair of supports 20 that have been inserted through the support loops 18.

The bottom 22 of the receptacle 10 is comprised of four bottom pieces that are folded upward to form a substantially flat bottom 22. The four bottom pieces include a front bottom piece 24, a back bottom piece 26, and two side bottom pieces 28 and 29.

The four bottom pieces are better shown in FIGS. 3–6, wherein the receptacle 10 is shown in the open position. In the open position, the bottom pieces are unfolded and extend downward from the sides 12, 13, 15, and 17 to form a generally conical hopper 30. In FIG. 3, it can be seen that the front bottom piece 24 is trapezoidal, tapering downward from the bottom edge 31 of side 12. The two side bottom pieces 28 and 29 are shown to be triangular in FIGS. 4 and 6. The back bottom piece 26 is also triangular, but extends downward beyond the lower corners of the side bottom pieces 28 and 29.

The edges of the bottom pieces 24, 26, 28, and 29 are sewn together to form the generally conical hopper 30. The hopper 30 includes the two triangular side bottom pieces 28 and 29 and two trapezoidal sides formed by the front bottom piece 24 and the back bottom piece 26. A portion 32 of the back bottom piece 26 extends downward below the intersection 33 of the four bottom pieces 24, 26, 28, and 29.

To close the receptacle 10, the two side bottom pieces 28 are folded inward first. Then the front bottom piece 24 and the back bottom piece 26 are folded inward and across the bottom 22 of the receptacle 10 as shown in FIG. 2.

The bottom pieces 24, 26, 28, and 29 are secured in the closed position by a loop 34 attached to the bottom corner of the back bottom piece 26. In the closed position, shown in FIGS. 1 and 2, the loop 34 extends outward beyond one of the sides 12 of the receptacle 10. The loop 34 is held in place by a pair of tie ropes 35 that extend downward from rings 37 on one side 12 of the enclosure 11 and are tied together.

Figure 6:
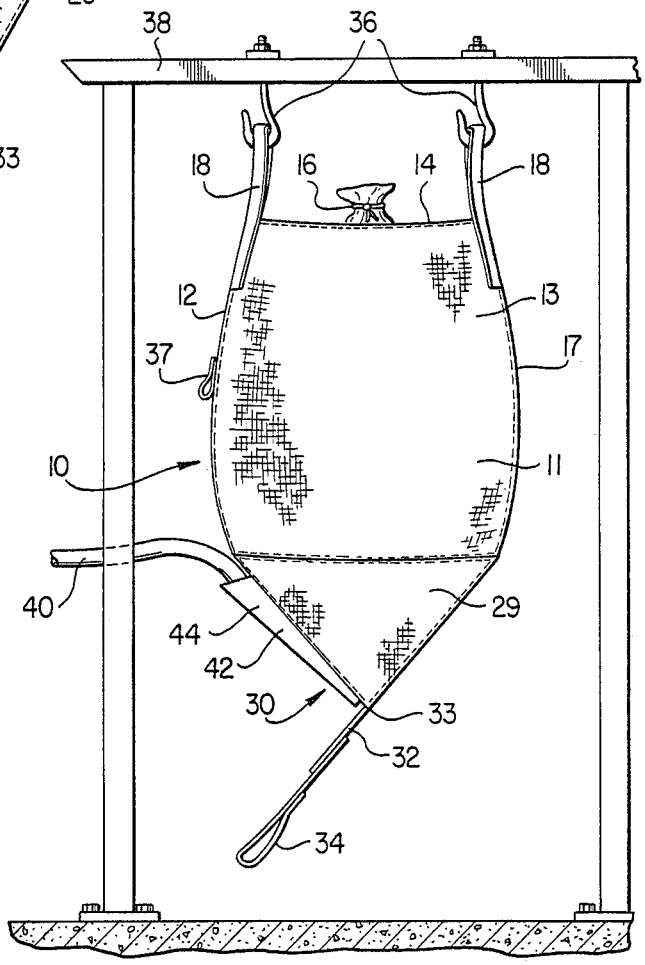
FIG. 6 is a side view of the receptacle of the invention opposite that shown in FIG. 4 and shown mounted on a support with a transfer system inserted into the discharge tube.

FIG. 6 illustrates the receptacle 10 being emptied. The receptacle 10 is suspended from hooks 36 that extend downward from a support 38. A hose 40 from a pneumatic transfer system (not shown) is inserted into a discharge tube 42 on the hopper 30.

As shown best in FIG. 3, the discharge tube 42 is formed by attaching a cover piece 44 to the front bottom piece 24. The cover piece 44 is of a shape such that when the bottom and sides of the cover piece 44 are sewn to the front bottom piece 24, a tube 42 is formed that is open at the top and closed at the bottom. An opening 46 in the front bottom piece 24 is overlapped by cover piece 44 and allows material from within the receptacle 10 to flow into the discharge tube 42. The transfer system draws the material out of the discharge tube 42.

To fill the receptacle 10, the bottom pieces 24, 26, 28, and 29 are first folded shut and secured, as shown in FIGS. 1 and 2. Material is then poured into the top 14 of the receptacle 10. When the receptacle 10 is full, the top 14 is closed and secured with the wire tie 16. The full receptacle 10 is then carried either by lifting the support loops 18 or by supporting the flat bottom 22 of the receptacle 10 on a pallet.

To empty the receptacle 10, the receptacle 10 is first suspended by the support loops 18. The tie ropes 35 are then untied. This allows the bottom pieces 24, 26, 28, and 29 to unfold, forming the hopper 30 below the main enclosure 11 of the receptacle 10. A discharge device, such as the hose 40 of a pneumatic transfer system, is then inserted into the discharge tube 42. The hose 40 draws the material out of the receptacle 10 through the opening 46 and the discharge tube 42.

The receptacle 10 of the invention has several advantages over the prior art. When full, the receptacle 10 can be supported either by the loops 18 or by the flat bottom 22. The bottom pieces 24, 26, 28, and 29 can be easily unfolded to form the conical hopper 30 below the sides 12, 13, 15, and 17 of the receptacle 10. The material inside the receptacle 10 will not flow out of the receptacle 10 without being drawn out of the upper end of the discharge tube 42. After the receptacle 10 has been emptied, the bottom pieces can be folded and secured to form a substantially flat bottom 22.

Only the preferred embodiment of the invention has been shown. It should be understood that the invention is not limited to the embodiment disclosed, but is capable of numerous rearrangements, modifications, and substitutions of parts and elements without departing from the spirit of the invention.

I claim:

1. A material holding receptacle constructed of pliable material comprising:

a main enclosure having top and bottom edges;

a lower portion generally in the shape of a cone attached to the bottom edge of the main enclosure, the lower portion having an opening forming access to the interior of the receptacle; and a covering attached to the lower portion over the opening to form a tube open at one end and closed at the other to provide access to the interior of the receptacle through the opening.

2. A receptacle as recited in claim 1, further comprising:

closure means attached to the lower portion below the opening for closing the receptacle; and means attached to the main enclosure for securing the closure means when the lower portion is folded upward toward the main enclosure so as to seal the opening and form a flat bottom when the receptacle is filled with material.

3. A material handling receptacle constructed of pliable material comprising:

four side pieces joined at their abutting edges to form an enclosure having lower edges that generally form a square;

four generally triangular bottom pieces, each bottom piece attached to and extending downward from one of the side pieces, the bottom pieces being connected together to form a substantially conical portion, one of the bottom pieces having an opening for access to the interior of the receptacle; and a cover piece connected to the bottom piece over the opening so as to form a tube open at the top and closed at the bottom and forming access to the opening.

4. The receptacle as recited in claim 3, further comprising:

a fastener attached to one of the bottom pieces for closing the receptacle opening; and means attached to at least one of the side pieces for securing the fastener when the receptacle is closed.

5. The receptacle as recited in claim 3, wherein the bottom pieces can be folded upward toward the side pieces to close the receptacle and simultaneously form a substantially flat bottom on the receptacle.

6. The receptacle as recited in claim 3, wherein the cover piece has bottom and side edges attached to the bottom piece having the opening to form the access to the opening.

7. A material handling receptacle constructed of pliable material comprising:

a main enclosure;

a trapezoidal bottom piece, extending downward from the main enclosure and having an opening;

three triangular bottom pieces, extending downward from the main enclosure and connected to the trapezoidal bottom piece and to one another to form a hopper below the main enclosure; and a cover piece, attached to the trapezoidal bottom piece over the opening so as to form access to the opening.

8. The receptacle as recited in claim 7, further comprising:

a loop attached to the bottom corner of one of the bottom pieces; and means attached to the main enclosure for securing the loop to close the receptacle.

9. The receptacle as recited in claim 7, wherein the bottom pieces can be folded upward to form a closed and substantially flat bottom to the receptacle.

10. The receptacle as recited in claim 7, wherein the cover Piece has bottom and side edges attached to the trapezoidal bottom piece to form the access to the opening.

11. A material handling receptacle constructed of pliable material comprising:

four sides having lower edges that generally form a square;

a trapezoidal bottom piece, having an opening, extending downward from one of the sides;

three triangular bottom pieces, extending downward from the remaining three sides and connected to the trapezoidal bottom piece and to one another to form a hopper below the sides, the bottom pieces being upwardly foldable to form a closed and substantially flat bottom to the receptacle;

a cover piece, having bottom and side edges attached to the trapezoidal bottom piece to form an access tube over the opening in the trapezoidal bottom piece; and a loop attached to the bottom corner of one of the bottom pieces for closing the receptacle when the bottom pieces are folded upward.

* * * * *